United States Patent [19]

Espenschied

[11] 4,138,983

[45] Feb. 13, 1979

[54] ENGINE IGNITION SYSTEM WITH ELECTROMAGNET CONTROL OF ENCLOSED DISTRIBUTOR GAPS

[75] Inventor: Helmut Espenschied, Ludwigsburg, Germany

[73] Assignee: Robert Bosch GmbH, Stuttgart, Fed. Rep. of Germany

[21] Appl. No.: 845,795

[22] Filed: Oct. 26, 1977

[30] Foreign Application Priority Data

Oct. 29, 1976 [DE] Fed. Rep. of Germany ..... 2649844

[51] Int. Cl.[2] ..... F02P 1/00

[52] U.S. Cl. ..... 123/148 DK; 123/148 ND; 123/148 E; 200/19 M; 315/209 M

[58] Field of Search .... 123/148 E, 148 ND, 146.5 A, 123/148 DK; 200/19 R, 19 M, 19 DC; 315/209 R, 209 T, 209 M

[56] References Cited

U.S. PATENT DOCUMENTS

| | | | |
|---|---|---|---|
| 3,504,229 | 3/1970 | Gerry | 315/209 M |
| 3,951,144 | 4/1976 | Siegle | 315/209 R |
| 3,961,604 | 6/1976 | Shimrony | 200/19 M |
| 4,019,486 | 4/1977 | Siegle | 315/209 R |
| 4,044,747 | 8/1977 | Longstaff | 123/148 ND |

*Primary Examiner*—William C. Cooper
*Assistant Examiner*—Gerald L. Brigance
*Attorney, Agent, or Firm*—Flynn & Frishauf

[57] ABSTRACT

The cathode of the gas-discharge devices performing the distributor function for associated sparkplugs have lateral extension flanges approaching closely to the insulating envelopes of the devices. A grounded control electrode just outside the gas-discharge device is moved from a rest position to an operating position aligned with and adjacent to the cathode extension flange by an electromagnet operated by a transistor circuit in accordance with the cylinder firing order of the engine.

9 Claims, 4 Drawing Figures

S
U
U2
U1
t

ENGINE IGNITION SYSTEM WITH ELECTROMAGNET CONTROL OF ENCLOSED DISTRIBUTOR GAPS

This invention concerns an ignition system for an internal combustion engine of the kind in which hollow gas-filled envelopes of an insulating material, such as glass, containing auxiliary spark gap electrodes of which the breakdown voltage is influenced by an external control electrode, are used for performing the distribution function for determining which of a group of sparkplugs will be fired which the next ignition pulse provided by the high-voltage coil of the ignition transformer. This general type of ignition system is known from German published Pat. application (OS) No. 2,233,830 in which a controllable electronic high-voltage switching device is provided for the high-voltage distributor function in gasoline motor ignition systems and utilizes as control electrode an engine driven rotary member that is movable past the cathode enlargements of the individual high-voltage switches and is equipped with bodies having particular potential applied to them or with fixed bodies respectively corresponding to the individual high-voltage switches. In the latter case, the control potential is to be applied to the respective fixed bodies momentarily in a predetermined order (firing order). If, however, the control electrode utilizes a body that must be put into rotation while the engine is running, complication and expense results in arranging the disposition of the rotary body for cooperation with the associated high-voltage switch or switches and its mechanical coupling with the engine. If fixed rather than rotary bodies are used as the control electrodes for the respective high-voltage switches, then special means are required in order to apply the control potential in the specified firing order at exactly the right firing moment.

The Present Invention. It is an object of the present invention to provide an ignition system in which the breakdown voltage of the auxiliary gaps in the gas-filled envelopes can be selectively reduced in the required firing order without expensive mechanical coupling and without complicated switching of potentials applied to the respective control electrodes.

Briefly, at least one electromagnet is provided for selectively moving the respective control electrodes in turn alongside the respective lateral extensions of the respective cathodes of the high-voltage switches. In one embodiment, each control electrode is movable by an electromagnet individually associated with it against a restoring force that is preferably a mechanical spring force. In another embodiment, a single magnet core is provided with two electromagnet windings for exciting it in different polarities and control electrodes disposed near the respective ends of the cores are equipped with permanent magnets, so that magnetization of the core in one direction will displace one control electrode at one end of the core and magnetization of the core in the other polarity will displace the other control electrode in a similar manner a magnetic restoring force is convenient in this embodiment.

The ignition system of the invention has the advantage that the control electrodes, in spite of their movability, have definite rest and operated positions, and can be mounted in a simple manner and, further, that the control electrodes and their electromagnets are easily built into the ingition system in a space-economizing manner.

In a particularly useful form of the invention, the auxiliary gap devices constituting the high-voltage switches, their associated control electrodes and electromagnets are encased in a body of insulating material equipped with receptacles for receiving contact plugs, such a body being conveniently formed to constitute also the cap of an ignition coil.

Drawings, illustrating an embodiment:

FIG. 1 of the annexed drawings is a circuit diagram of an ignition system according to the present invention;

Figure 1:
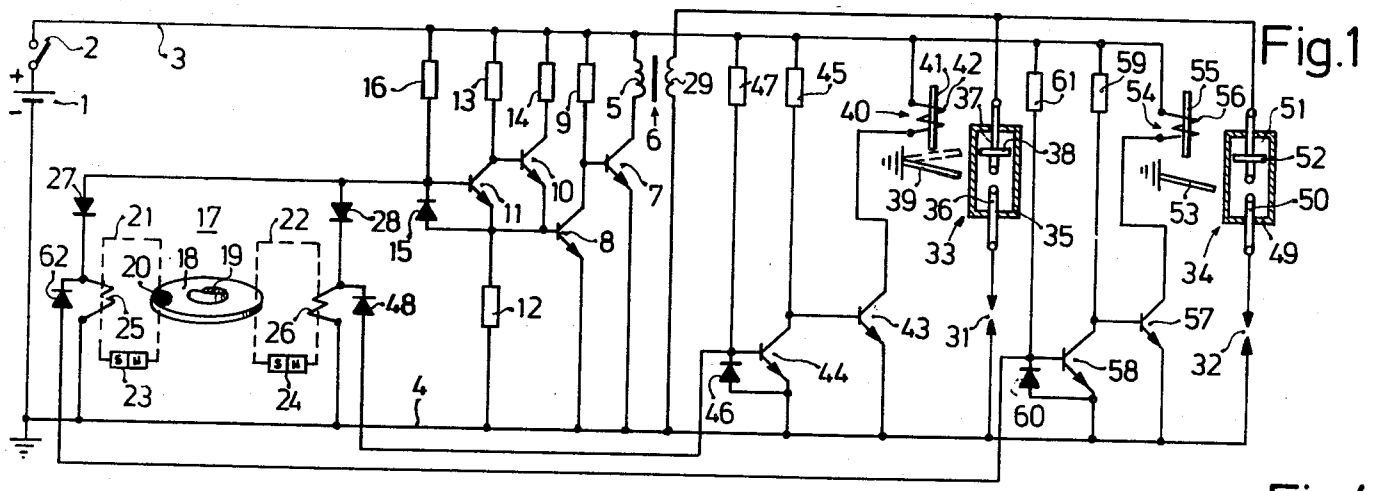

The ignition system diagrammed in FIG. 1 is designed for the gasoline engine of a motor vehicle. It is powered by a dc voltage source 1 that can be the motor vehicle storage battery. From the positive terminal of the dc source 1, a first connection line 3 proceeds that has interposed therein the usual ignition on-off switch 2 and, similarly, from the negative terminal of the dc source 1, a second connection line 4 is provided that is connected to chassis ground. There is a circuit branch that proceeds from the connection line 3 through the primary winding 5 of an ignition coil 6 to the collector of the final stage transistor 7 and then from the emitter of this transistor 7 to the second connection line 4 of the dc source 1. The final stage transistor 7 in the illustrated case, of course, is an npn transistor. The base electrode of the final stage transistor 7 is connected to the collector of an npn transistor 8 and also through a resistor 9 to the first battery connection line 3. The emitter of the transistor 8 is connected to the second battery connection line 4 and the base of the transistor 8 is connected to the emitter of another npn transistor 10 and also to the emitter of still another npn transistor 11 and, finally, also through a resistor 12 to the second battery connection line 4.

The transistor 10 has its base connected to the collector of the transistor 11 and also connected through a resistor 13 to the first battery connection line 3. In addition, the transistor 10 has its collector connected through a resistance 14 to the first battery connection line 3. The emitter of the transistor 11 is connected to the anode of a diode 15, the cathode of which is connected to the base of the same transistor 11. The base of the transistor 11 is also connected through a resistance 16 to the first battery connection line 3. The transistors 10 and 11, together with their associated resistances 12, 13 and 14, form a threshold switch that operates after the fashion of a Schmitt trigger circuit. The base of the transistor 11 that constitutes the input of the threshold switch is subjected to the influence of a signal generator 13. The signal generator 13 here shown operates inductively and contains a disc 18, consisting of a material that is magnetically nonconductive, for example synthetic resin, seated on a shaft 19 and carrying an armature 20 of magnetically conducting material, such as soft iron, on a portion of its periphery. The shaft 19 is coupled to the engine. The signal generator 17 is constituted so as to provide two magnetic circuits 21 and 22 both shown in broken lines, the magnetic circuit 21 including a permanent magnet 24 and the magnetic circuit 22 a permanent magnet 24. The magnetic circuit 21 links a signal transmitter winding 25 and the magnetic circuit 22 links a signal transmitter winding 26, in both cases by inductive coupling. The signal transmitter windings 25 and 26 each have one end connected to the second battery connection line 4, while their other ends are respectively connected to the cathodes of two diodes 27 and 28, the respective anodes of which are connected to the base of the transistor 11. The armature piece 20 of the disc 18 alternately closes the two magnetic circuits 21 and 22 at 180° intervals of rotation of the disc 18.

High-voltage pulses are produced in the secondary winding 29 belonging to the ignition coil 6 and made available for the individual ignition processes that are to be provided alternately for the two sparkplugs 31 and 32. For this purpose, a high-voltage switch 33 is provided for the sparkplug 31 and a high-voltage switch 34 is similarly interposed ahead of the spark-plug 32. The high-voltage switch 33 has a small tubular hollow body 35 closed at its two ends and filled with gas, preferably a noble gas such as argon, with rod-shaped electrodes brought in through the two ends in alignment with the longitudinal axis of the tubular body 35, namely an anode electrode 36 at one end and a cathode electrode 37 likewise projecting into the interior from the other end. The electrodes 36 and 37 are spaced from each other, the electrodes 37 having a lateral extension or broadening 38 that is preferably of disc shape and projects at least approximately to the lateral walls of the envelope body 35. The anode electrode 36 and the cathode electrode 37, including in the latter case the lateral extension 38, consist of an electrically conducting material, for example an alloy of iron, cobalt and nickel, whereas the envelope body 35 consists of an insulating material, for example glass. The high-voltage switch 33 is provided with a control electrode 39 adjacently outside of the envelope body 35, the initial or rest position of the control electrode 39 being towards the anode electrode 36 and the operated position of the control electrode 39 being alongside the lateral extension 38 of the cathode electrode 37. The movement of the control electrode 39 is produced by means of an electromagnet 40, that consists of an iron core 41 and a control winding 42 thereon. The winding 42 has one end connected to the first battery connection line 3 and the other end connected to the collector of an npn transistor 43. The emitter of the transistor 43 is connected to the second battery connection line 4 and the base of that transistor is connected to the collector of another npn transistor 44 and also connected through a resistance 45 to the first battery connection line 3. A diode 46 is interposed between the base and the emitter of the transistor 44, with its anode facing the emitter. The base of the transistor 44 is also connected through a resistor 47 to the first battery connection line 3 and through a diode 48 to the end of the signal transmitter winding 26 that is the nearer to the second battery connection line 4. The cathode of the last-mentioned diode 48 is turned towards the winding 26.

The high-voltage switch 44 is constituted in the same way as the high-voltage switch 33. Its envelope is designated 49, its anode electrode 50, its cathode electrode 51 and the lateral extension of the latter 52, while the corresponding external control electrode is designated 53.

For moving the control electrode 53 from the rest position to the operated position, an electromagnet 54 is used that consists of an iron core 55 and a magnetizing winding 56 wound thereon. The winding 56 has one end connected to the first battery connection line 3 and the other end connected to the collector of an npn transistor 57, which has its emitter connected to the second battery connection line 4 and its base connected to the collector of a transistor 58 and also connected through a resistor 59 to the first battery connection line 3. The emitter of the transistor 58 is connected to the second battery connection line 4 and a diode 60 is interposed between the base and the emitter of the transistor 58, with the anode of the diode facing the base of transistor which is also connected through a resistance 61 to the first battery connection line 3 and through a diode end of the signal generator winding 25 that is the nearer to the second battery connection line 4, while the cathode of the diode 62 is turned towards the winding 25.

The secondary winding 29 is connected with the cathode electrodes 37 and 51 in such a way that the high-voltage pulse produced is applied as a negative high-voltage potential, with reference to zero potential (chassis ground potential of the second battery connection 4), to these electrodes 37 and 51. The control electrodes 39 and 53 must have a positive potential with respect to the cathode electrodes 37 and 51 respectively when they exert their respective control powers, which is accomplished in this case by applying zero potential to the control electrodes 39 and 53. Such a connection is convenient because the fastening and construction of the control electrodes 39 and 53 involves no complications or difficulties.

Figure 2:
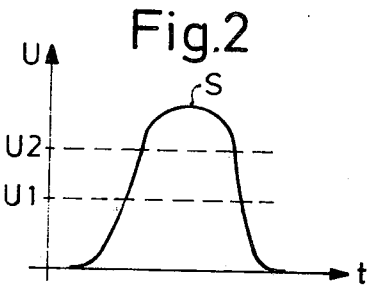
FIG. 2 is a graph of voltage (U) against time (t) for explaining the high-voltage switch control process.

Operation of the circuit above described: As soon as the ignition switch 2 is closed, the system is ready for operation. It will be initially assumed that the transistor 11 has its emitter-collector path in the conducting condition, so that the emitter-collector path of the transistor 10 is nonconducting, that of the transistor 8 is likewise nonconducting and that of the final stage transistor 7 is conducting. Current flows accordingly freely through the primary winding 5, thereby storing energy in the spark coil 6 for the forthcoming ignition event. If now, as represented in the drawing, the armature piece 20 is moved across and through the magnetic circuit 21, an alternating voltage cycle is produced in the signal transmitter winding 25. The half-wave S of this alternating voltage cycle identified in FIG. 2 is utilized for the triggering of the ignition event. First, the high-voltage switch 34 is prepared for entertaining a discharge, in order to assure that the next high-voltage pulse delivered by the secondary winding 29 will produce an electric discharge (ignition spark) in the sparkplug 32. The necessary preparation of the high-voltage switch 34 for an auxiliary discharge is accomplished when the voltage half-wave S reaches the voltage value $U_1$. The bias voltage on the base of the transistor 58 is now so far reduced by the diode 60 that the emitter-collector path of this transistor 58 is put into the nonconducting condition. Control current can then flow through the base-emitter path of the transistor 57, so that the emitter-collector path of this transistor 57 becomes conductive and current flows through the magnetizing winding 56 of the electromagnet 54. In consequence, the magnetized iron core 55 draws the control electrode 53 into its operated position, so that the control electrode 53 is put adjacent to the lateral extension 52 of the cathode electrode 51, in such a way that it lies in the vicinity of at least part of an extension in space of the feature 52 beyond its end. So long as the voltage half-wave S is at a voltage value greater than $U_1$, the operating condition just described of the high-voltage switch 34 is maintained. If now the voltage half-wave S reaches the voltage value $U_2$, the bias voltage at the base of the transistor 11 is reduced by the diode 15 to the extent that the emitter-collector path of this transistor 11 is put into the nonconducting condition. That has the consequence that the emitter-collector path of the transistor 10, and dependent thereon, also the emitter-collector path of the transistor 8, are put into the conducting condition. In consequence, the emitter-collector path of the final stage transistor 7 becomes nonconducting and the current in the primary winding 5 is interrupted. A high-voltage pulse then is produced in the secondary winding 29. By means of the pre-ionizing effect of the control electrode 53, the discharge between the anode electrode 50 and the cathode electrode 51 is caused to be produced in the high-voltage switch 34 that results in the ignition spark being caused to take place in the sparkplug 32. After the voltage half-wave S has subsided below the voltage value $U_2$, the emitter-collector path of the transistor 11 becomes conducting again and the emitter-collector path of the transistor 10 and that of the transistor 8 become non-conducting, so that the emitter-collector path of the final stage transistor 7 becomes conducting, so that current again flows through the primary winding 5 and energy begins to be stored anew in the spark coil 6 for the next ignition event. As the voltage half-wave S subsides further below the voltage value $U_1$, the emitter-collector path of the transistor 58 becomes conducting again and that of the transistor 57 becomes again nonconducting, so that the electromagnet 54 is shut off and the control electrode 53 goes back into the quiescent or normal state. The state of preparation of the high-voltage switch 34 for an auxiliary discharge therein is now brought to an end.

Figure 3:
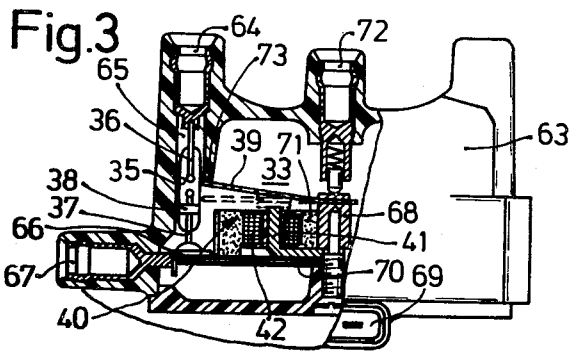
FIG. 3 is a cross-section of the cap of an ignition transformer in which the high-voltage distribution system embodying the present invention is incorporated.

FIG. 3 shows a preferred form of construction for the high-voltage distributor system of the invention. The insulated casing body 63 is shown partly is section to reveal the high-voltage switch 33 of FIG. 1, the various individual parts of which are given the same reference numerals as are used to designate them in FIG. 1. In the preferred case, the insulating body 63 is designed to serve as the cap that closes off the top of a casing enclosing the spark coil. The cap-like body 63 is provided with sockets for accepting plug connectors for establishing the necessary electrical connections with the individual components contained in the cap. Thus, for example, the socket 64 serves for establishing the connections between the electrode 36 and the sparkplug 31. The seat of the socket connector 64 communicates with an inwards-running bore 65 in which the hollow envelope 35 is seated. The outer end of the cathode electrode 37 is supported on a contact bracket 66 against which the contact socket of an additional socket connector 67 presses. The contact socket 67 serves for establishing the connection between the cathode electrode 37 and the secondary winding 29. The control electrode 39 in the preferred case is constituted as a leaf spring having one end clamped fast in a central pedestal 68. The central pedestal 68 forms the yoke portion in the magnetic circuit of the electromagnet 40 and accordingly, like the control electrode 39, consists of a magnetically conductive (permeable) material. The iron core member 41 extends from the foot of the central pedestal 68 and is bent up at a certain spacing from the central pedestal 68 towards the control electrode 39, this bent-up portion carrying the magnetizing winding 42. The electrical connection with the winding 42 is readily provided through a connector device 69 and conveniently sections of such connections can pass through conduction paths of a conductor pattern plate 70. Electromagnet 40 can be held securely in place by filling the space around it with a potting synthetic resin 71.

The control electrode 39 has zero potential applied to it through a connector socket 72 from which a connection can readily be made to the second battery connection line 4, which in FIG. 1 is shown connected to chassis ground. All control electrodes 39, 53 and/or all iron cores 41, 55 can branch out in star configuration from a central clamped portion engaged in the structure of the central pedestal 68. The high-voltage switches 33,34 are then disposed around an imaginary circle concentric with the central pedestal. The control electrodes 39,53 are designed to be supported for positioning in their respective rest and operated positions, by means of the boundary edge 73 of the bore 65 for the rest position and by means of the free ends of the respective iron cores 41 and 55 for the operated position, with a spacer as may be suitable to prevent sticking.

The high-voltage switch 34, which is not shown in FIG. 3 to simplify the representation, is constituted in the same way as shown and described with respect to the high-voltage switch 33. In the illustrated case in which there are just two high-voltage switches, the individual parts of the high-voltage switch 34 accordingly have positions symmetrical with respect to those of corresponding parts of the switch 33. If the engine has more than two cylinders and accordingly also a larger number of high-voltage switches, these will again be arrayed around a center provided by the pedestal 68.

Figure 4:
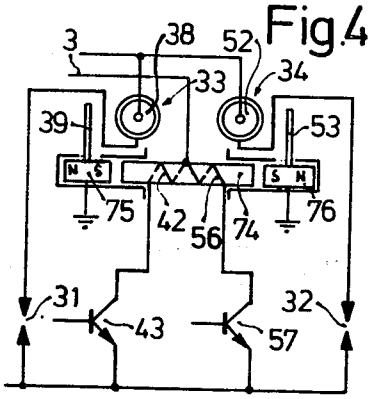
FIG. 4 is a circuit diagram of a portion of a modification of the ignition system of FIG. 1.

In the example illustrated in FIG. 3, the control electrodes 39 and 53 are restored to their respective rest positions by their spring forces. The restoring force can, however, be a magnetic force, as illustrated in FIG. 4. Here only a single iron core 74 is used for the two magnetizing windings 42 and 56. The direction of these windings or else the direction of current flow through them is so selected that the magnetic polarity at the ends of the iron core 74 is in one direction for current flow through one magnetizing winding and is opposite for current flow through the other winding. Permanent magnets 75 and 76 are located opposite the respective end faces of the core 74. The two control electrodes 39 and 53 are affixed to the magnets 75 and 76 in such a manner that in each case the control electrode is pulled sideways towards the cathode extension 38 or 52 as the case may be, as soon as the magnet 75 or 76 carrying the control electrode in question is pulled by the core 74. Since the magnets 75 and 76 face the core 74 with their same pole, in the illustrated case the south pole, when current flows through the winding 42, the magnet 75 is pulled by the core and when current flows through the winding 54, the magnet 76 is similarly pulled. If the windings 42 and 54 are within current, the magnets 75 and 76 are repelled by the core 74, because then the magnet poles of the same polarity react against each other. The two control electrodes 39 and 53 accordingly take up their rest positions during the absence of current in both windings 42 and 54. On the other hand, during current flow in one of the two windings 42 and 54, one of the two magnets 75, 76 is attracted and the other repelled by the core 74, thus assuring that only one of the two control electrodes 39, 53 prepares its associated high-voltage switch 33 or 34, as the case may be, for the occurrence of a switching discharge. The electronic high-voltage switches 33 and 34 lend themselves to being put in readiness for discharge in accordance with ignition timing and cylinder firing order by the respective transistors 43 and 57 in the same manner as in FIG. 1, so that in this case the high-voltage pulses are distributed to the sparkplugs 31 and 32 in the manner already described with reference to FIG. 1.

By the use of discharge paths provided in gas-filled envelope bodies for distributing high-voltage pulses to sparkplugs, the advantage is obtained that the distributor function can no longer be appreciably disturbed by leakage paths caused by moisture, in contrast to the conventional distributor in which a distributor arm moves past fixed contacts at a certain spacing therefrom and thereby provokes discharges through an air gap.

Although the invention has been described with reference to particular illustrative embodiments, it will be recognized that variations are possible within the inventive concept. For example the cap structure illustrated in FIG. 3 may constitute the cap for an existing rotary arm distributor unit in order to convert a conventional ignition system to a system embodying the present invention, by substituting the equipment of the new cap for the rotary distributor which is then disconnected from the circuit, as by removing the rotor.

I claim:

1. An ignition system for an internal combustion engine, said ignition system having a plurality of high-voltage switches contained in hollow gas-filled envelopes of insulating material for switching spark plugs, said switches comprising in each gas-filled envelope a cathode electrode and an anode electrode projecting into the interior of said envelope and means adjacently outside the envelope including a nearby movable control electrode at a predetermined potential for promoting the allocation of a high-voltage pulse to the cathode and anode of the neighboring envelope in one but not all of the positions to which said electrode is movable, each said cathode having in the respective envelope a lateral extension reaching at least approximately to the wall of said envelope, said control electrode being arranged to be movable outside said envelope so as to move past a position at least partly consituting a further extension of said lateral extension of said cathode in order to promote a discharge of said high-voltage pulse in said envelope, said system having the improvement which consists in that: at least one electromagnet is provided for controlling said movable electrodes, and said at least one electromagnet, when selectively energized, moves at least one respective control electrode (39, 53) alongside the lateral extension (38,52) of the cathode of a corresponding high-voltage switch (33,34).

2. An ignition system as defined in claim 1, in which said at least one electromagnet has an iron core energizable by a winding (42, 56) wound thereon and each control electrode is subject to a restoring force which acts against the motion imparted by the electromagnet.

3. An ignition system as defined in claim 2, in which the constitution of each said control electrode and its mounting is such that said restoring force is provided in the form of a mechanical spring force.

4. An ignition system as defined in claim 3, in which each said control electrode (39,53) is a clamped leaf spring.

5. An ignition system as defined in claim 2, in which said restoring force is a magnetic force.

6. An ignition system as defined in claim 1, in which said at least one electromagnet (74) is provided with two magnetizing windings (42,56) for magnetizing an iron core (74) selectively in opposite polarities by flow of current through one or the other winding, respectively, and in which two of said control electrodes (39,53) are provided at the two respective ends of said core (74) of said at least one electromagnet, and in which the two control electrodes (39,53), provided at the respective ends of said core (74) of said at least one electromagnet, respectively have magnets (75,76) fastened thereon spaced from the ends of said core (74) with the same pole polarity facing towards the respective ends of said core (74).

7. An ignition system as defined in claim 2, in which each of said high-voltage switches (33,34), together with its control electrode (39,53) and electromagnet, is incorporated in an insulating body (63) provided with connection sockets (64,67,69,72) for receiving connection plugs.

8. An ignition system as defined in claim 7, in which said insulating body (63) is constituted as the cover cap of an ignition coil unit.

9. An ignition system as defined in claim 8, in which said insulting body (63) is constituted as the cover cap of an ignition distributor unit.

* * * * *